US007780940B2

(12) United States Patent
Chen et al.

(10) Patent No.: US 7,780,940 B2
(45) **Date of Patent: *Aug. 24, 2010**

(54) LASER-BASED METHOD FOR GROWING ARRAY OF CARBON NANOTUBES

(75) Inventors: Zhuo Chen, Beijing (CN); Chun-Xiang Luo, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 502 days.

This patent is subject to a terminal disclaimer.

(21) Appl. No.: 11/982,669

(22) Filed: Nov. 2, 2007

(65) Prior Publication Data

US 2008/0159946 A1 Jul. 3, 2008

(30) Foreign Application Priority Data

Dec. 29, 2006 (CN) ..... 2006 1 0064580

(51) Int. Cl.
*D01C 5/00* (2006.01)

(52) U.S. Cl. ..... 423/447.3; 423/445 B; 977/742; 977/843

(58) Field of Classification Search ..... 423/447.3, 423/445 B; 977/742, 843
See application file for complete search history.

(56) References Cited

U.S. PATENT DOCUMENTS 6,440,763 B1 * 8/2002 Hsu ..... 438/20
6,887,451 B2 * 5/2005 Dodelet et al. ..... 423/447.3
6,917,058 B2 * 7/2005 Niigaki et al. ..... 257/103
6,986,876 B2 * 1/2006 Smalley et al. ..... 423/447.1
7,357,691 B2 4/2008 Liu et al.
7,448,931 B2 11/2008 Liu et al.
2003/0130114 A1 * 7/2003 Hampden-Smith et al. .. 502/180
2004/0209385 A1 10/2004 Liu et al.
2005/0000438 A1 * 1/2005 Lim et al. ..... 118/722
2005/0052127 A1 * 3/2005 Sakata et al. ..... 313/506
2006/0263524 A1 11/2006 Jiang et al.

OTHER PUBLICATIONS

Carbon nanotube films grown by laser-assisted chemical vapor deposition F. Rohmund, R.-E. Morjan, G. Ledoux, F. Huisken, and R. Alexandrescu, J. Vac. Sci. Technol. B 20, 802 (2002), DOI:10.1116/1.1469013.*

Kinghong Kwok, Wilson K.S. Chiu. "Growth of carbon nanotubes by open-air laser-induced chemical vapor deposition". Carbon, 2005, vol. 43, p. 437-446.

* cited by examiner

*Primary Examiner*—Stuart Hendrickson
*Assistant Examiner*—Richard M Rump
(74) *Attorney, Agent, or Firm*—Jeffrey T. Knapp

(57) ABSTRACT

A method for making an array of carbon nanotubes includes the steps of: (a) providing a substrate having a first surface and a second surface opposite to the first surface; (b) forming a catalyst film on the first surface of the substrate; (c) flowing a mixture of a carrier gas and a carbon source gas over the catalyst film; (d) generating a laser beam using a galvanometric scanning system, directing the laser beam toward/on one of the first surface and the second surface to locally heat the catalyst film to a predetermined temperature; and (e) growing an array of the carbon nanotubes from the substrate.

17 Claims, 4 Drawing Sheets

LASER-BASED METHOD FOR GROWING ARRAY OF CARBON NANOTUBES

RELATED APPLICATIONS

This application is related to commonly-assigned applications entitled, "LASER-BASED METHOD FOR GROWING ARRAY OF CARBON NANOTUBES", filed Nov. 2, 2007 Ser. No. 11/982/669; "LASER-BASED METHOD FOR GROWING ARRAY OF CARBON NANOTUBES", Nov. 2, 2007 Ser. No. 11/982,517; "LASER-BASED METHOD FOR GROWING ARRAY OF CARBON NANOTUBES", filed Nov. 2, 2007 Ser. No. 11/982,667; "LASER-BASED METHOD FOR GROWING AN ARRAY OF CARBON NANOTUBES", filed Nov. 2, 2007 Ser. No. 11/982,489; "LASER-BASED METHOD FOR MAKING FIELD EMISSION CATHODE", filed Nov. 2, 2007 Ser. No. 11/982,674; "LASER-BASED METHOD FOR MAKING FIELD EMISSION CATHODE", filed Nov. 2, 2007 Ser. No. 11/982,486. Disclosures of the above-identified applications are incorporated herein by reference.

BACKGROUND

1. Field of the Invention

The invention relates generally to methods for growing carbon nanotubes and, particularly, to a laser-based method for growing an array of carbon nanotubes.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs are electrically conductive along their length, chemically stable, and capable, individually, of having a very small diameter (much less than 100 nanometers) and large aspect ratios (length/diameter). Due to these and other properties, it has been suggested that CNTs can play an important role in various fields, such as microscopic electronics, field emission devices, thermal interface materials, etc.

Generally, there are three conventional methods for manufacturing CNTs. The first method is the arc discharge method, which was first discovered and reported in an article by Sumio Iijima entitled "Helical Microtubules of Graphitic Carbon" (Nature, Vol. 354, Nov. 7, 1991, pp. 56-58). The second method is the laser ablation method, which was reported in an article, by T. W. Ebbesen et al., entitled "Large-scale Synthesis of Carbon Nanotubes" (Nature, Vol. 358, 1992, pp. 220). The third method is the chemical vapor deposition (CVD) method, which was reported in an article by W. Z. Li entitled "Large-scale Synthesis of Aligned Carbon Nanotubes" (Science, Vol. 274, 1996, pp. 1701). The CVD method is advantageously useful in synthesis of an array of carbon nanotubes and is beneficial in mass production, improved length controllability, compatibility with conventional integrated circuit process, etc.

Three main CVD methods, i.e. the thermal CVD, plasma-enhanced CVD, and laser-induced CVD, have been developed for the synthesis of arrays of carbon nanotubes. In a conventional laser-induced CVD method, an opaque substrate, such as silicon, is disposed with a catalyst in a closed reactor filled with reactant gases, and either an argon ion laser or $CO_2$ laser is employed to directly irradiate laser light on the substrate to heat the substrate to a reaction temperature. By locally laser-heating the substrate, carbon nanotubes can be synthesized on the substrate.

However, the above-described laser-assisted CVD method is performed in a closed reactor filled with reactant gases. Thus, the above-described method required a complicated reaction device, and it is difficult to build and/or maintain a large-scale reactor device for CVD growth of carbon nanotubes on a large area substrate. Moreover, the newly grown carbon nanotubes tend to directly experience an intense laser field, which can potentially damage the newly grown carbon nanotubes. Thus, the morphology of the obtained carbon nanotubes can be compromised. These carbon nanotubes typically do not sufficiently exhibit the useful properties desired in an array of carbon nanotubes.

What is needed, therefore, is to provide a laser-induced method for growing an array of carbon nanotubes in which the above problems are eliminated or at least alleviated.

SUMMARY

A method for growing an array of carbon nanotubes includes the steps of: (a) providing a substrate having a first surface and a second surface opposite to the first surface; (b) forming a catalyst film on the first surface of the substrate; (c) flowing a mixture of a carrier gas and a carbon source gas over the catalyst film; (d) generating a laser beam using a galvanometric scanning system, directing the laser beam toward one of the first surface and the second surface to locally heat the catalyst film to a predetermined temperature; and (e) growing an array of the carbon nanotubes from the substrate.

Other advantages and novel features of the present method for growing an array of carbon nanotubes will become more apparent from the following detailed description of preferred embodiments, when taken in conjunction with the accompanying drawings.

BRIEF DESCRIPTION OF THE DRAWINGS

Many aspects of the present method for growing/producing an array of carbon nanotubes can be better understood with reference to the following drawings. The components in the drawings are not necessarily to scale, the emphasis instead being placed upon clearly illustrating the principles of the present method for growing/producing an array of carbon nanotubes.

Figure 1:
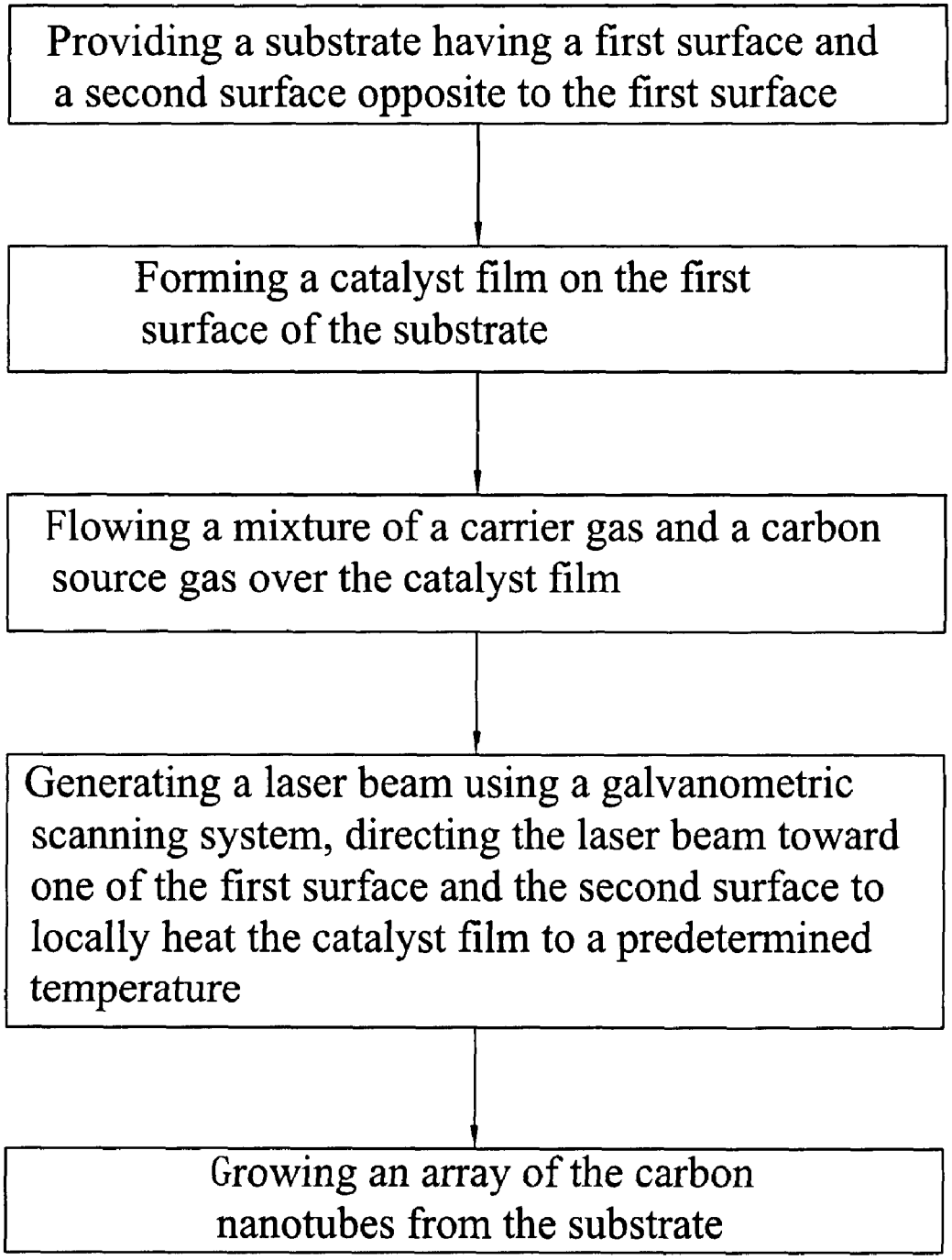
FIG. 1 is a flow chart of a method for growing an array of carbon nanotubes, in accordance with a present embodiment.

Corresponding reference characters indicate corresponding parts throughout the several views. The exemplifications set out herein illustrate at least one preferred embodiment of the present method for growing an array of carbon nanotubes, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present laser-based method for growing/forming an array of carbon nanotubes.

Referring to FIG. 1, a method for growing/producing an array of carbon nanotubes includes the steps of: (a) providing a substrate having a first surface and a second surface opposite to the first surface; (b) forming a catalyst film on the first surface of the substrate; (c) flowing a mixture of a carrier gas and a carbon source gas across the catalyst film; (d) generating a laser beam using a galvanometric scanning system, directing the laser beam toward one of the first surface and the second surface to locally heat the catalyst film to a predetermined temperature; and (e) growing an array of the carbon nanotubes from the substrate via the catalyst film.

In step (a), the substrate is, advantageously, made of a heat-resistant material (e.g., high-melting point, chemically durable), which can tolerate the high reaction temperature (e.g., upwards of about 600° C.). It is to be understood that depending on different applications, the material of the substrate could be selected from an opaque or transparent material, e.g., an opaque material such as silicon, silicon dioxide, or a metal for semiconductor electronic devices, or a transparent material such as a glass or plastic material for flat displays. When the transparent material is selected, the thickness of substrate itself does not affect the growth of carbon nanotube array, and the thickness can be chosen according to the actual applications. When the opaque material is selected, the thickness of substrate should be very thin, and, quite suitably, the thickness of substrate is less than 100 microns to facilitate rapid heat conduction.

In step (b), the catalyst film usefully is uniformly disposed on the substrate by means of chemical vapor deposition, thermal deposition, electron-beam deposition, and/or sputtering. The catalyst is beneficially made of iron, gallium nitride, cobalt, nickel, or any combination alloy thereof. The step (b) can, subsequent to catalyst formation, further include forming oxide catalyst particles through such means as high-temperature annealing.

In step (b), when the catalyst film includes the first carbonaceous/carbonous material, the method for making the catalyst film includes the substeps of: (b1) providing a mixture of a dispersant and a first carbonaceous material; (b2) mixing/combining the mixture with a solvent to form a solution; (b3) ultrasonically agitating the solution to promote the dispersion of the first carbonaceous material therein; (b4) adding a soluble catalyst material into the dispersed solution to form a catalyst solution; (b5) coating the catalyst solution on the first surface of the substrate; and (b6) baking the substrate to form a catalyst film that includes the first carbonaceous material (i.e., a carbon-carrying catalyst film) on the first surface of the substrate.

In step (b1), the first carbonaceous material can usefully be selected from carbon black (CB) and/or graphite. The dispersant is used for uniformly dispersing the first carbonaceous material. Quite suitably, the dispersant is sodium dodecyl benzene sulfonate (SDBS). A weight ratio of the dispersant to the first carbonaceous material is, advantageously, in the approximate range from 1:2 to 1:10. In step (b2), the solvent is, opportunely, water or ethanol. In one useful embodiment, an amount of SDBS in the range of about 0~100 mg (beneficially, a measurable amount of dispersant (i.e., above about 0 mg) is employed) and an amount of CB of about 100~500 mg are mixed into a volume of ethanol of about 10~100 ml to form the solution. Quite usefully, the solution is formed by combining about 50 mg of SDBS and about 150 mg of CB into about 40 ml of ethanol.

In step (b3), the solution can be sonicated (i.e., subjected to ultrasound) for, e.g., about 5 to 30 minutes to uniformly disperse/mix the first carbonaceous material in the solution. In step (b4), the soluble catalyst material, rather appropriately, include one or more metallic nitrate compounds selected from a group consisting of magnesium nitrate ($Mg(NO_3)_2.6H_2O$), iron nitrate ($Fe(NO_3)_3.9H_2O$), cobalt nitrate ($Co(NO_3)_2.6H_2O$), nickel nitrate ($Ni(NO_3)_2.6H_2O$), and any combination thereof. In one useful embodiment, after being treated with ultrasound for about 5 minutes, $Fe(NO_3)_3.9H_2O$ and $Mg(NO_3)_2.6H_2O$ is added to the solution, thereby forming the catalyst solution. Quite usefully, the catalyst solution includes about 0.01~0.5 Mol/L magnesium nitrate and about 0.01~0.5 Mol/L iron nitrate.

In step (b5), the catalyst solution is, beneficially, spin coated on the first surface of the substrate at a rotational speed of about 1000-5000 rpm. Quite suitably, the rotational speed for spin coating is about 1500 rpm. In step (b6), the substrate, with the catalyst solution coated thereon, is baked at about 60~100° C. for 10 min to 60 min. It is to be understood that the baking process is used to vaporize the solvent in the solution and accordingly form catalyst film on the first surface of the substrate, with the catalyst film thereby containing the first carbonaceous material.

An additional step (f) of forming a light absorption film on the first surface of the substrate is further provided before step (b).

In step (f), the light absorption film can be formed by the steps of: (f1) applying a second carbonaceous material layer onto the first surface of the substrate; (f2) gradually heating the substrate with the second carbonaceous material layer thereon for about 60~90 minutes to about 300~450° C. in an $N_2$ atmosphere and/or another inert gas; (f3) baking the substrate with the second carbonaceous material thereon for about 15~20 minutes once reaching the above-mentioned temperature; and (f4) cooling down the substrate with the second carbonaceous material thereon to room temperature and thereby forming/yielding a light absorption film on the first surface of the substrate.

In step (f1), the second carbonaceous material layer are advantageously made of materials having merits of good electrical conductivity, strong adhesion with the substrate, and compatibility with a high vacuum environment. Quite usefully, the second carbonaceous material is a commercial colloidal graphite, as used for CRTs. The second carbonaceous material can, beneficially, be spin-coated on the first surface of the substrate at a rotational speed of about 1000~5000 rpm. Quite suitably, the rotational speed for spin coating is about 1500 rpm. In step (f3), the baking process is, at least in part, to eliminate any impurities in the second carbonaceous material layer, such as any macromolecular material in the GIC (Graphite Inner Coating). The thickness of the formed light absorption layer is in the approximate range from 1 to 20 micrometers.

Step (b) further incorporates the steps of: (b7) providing a catalyst solution; (b8) coating the catalyst solution on the light absorption film; and (b9) baking the catalyst solution to form a catalyst film.

In step (b7), the catalyst can, opportunely, be made of iron, gallium nitride, cobalt, nickel, or any combination alloy thereof. In step (b8), in one useful embodiment, a catalyst-ethanol solution is spin-coated (~1500 rpm) on the GIC layer to form the film of catalyst. The catalyst-ethanol solution is a mixture solution of ethanol and one or more metallic nitrate compounds selected from a group consisting of magnesium nitrate ($Mg(NO_3)_2.6H_2O$), iron nitrate ($Fe(NO_3)_3.9H_2O$), cobalt nitrate ($Co(NO_3)_2.6H_2O$), nickel nitrate ($Ni(NO_3)_2.6H_2O$), and any combination thereof. Quite usefully, the catalyst ethanol solution includes about 0.01~0.5 Mol/L magnesium nitrate and about 0.01~0.5 Mol/L iron nitrate. The thickness of the formed catalyst film is in the approximate range from 1 to 100 nanometers.

In step (c), a carbon source gas, which is combined with a carrier gas, is flown over/adjacent the catalyst film. The carbon source gas acts as a primary source of carbon for growing the carbon nanotubes. In one useful embodiment, the carbon source gas and the carrier gas are directly introduced, in open air, by a nozzle to an area adjacent to the catalyst film. That is, the method can be operated without a closed reactor and/or without being under a vacuum. The carrier gas can, beneficially, be nitrogen ($N_2$) and/or a noble gas. The carbon source gas can, advantageously, be ethylene ($C_2H_4$), methane ($CH_4$), acetylene ($C_2H_2$), ethane ($C_2H_6$), or any combination thereof. Quite suitably, the carrier gas is argon (Ar), and the carbon source gas is acetylene. A ratio of the carrier gas flow-rate to the carbon source gas flow-rate is, opportunely, adjusted to be in an approximate range from 5:1 to 10:1. Quite usefully, the argon flow-rate is 200 sccm (Standard Cubic Centimeter per Minute), and the acetylene flow-rate is 25 sccm.

In step (d), the laser beam can be generated by a laser beam generator (e.g., a carbon dioxide laser, an argon ion laser, etc.). In one useful embodiment, the laser beam is generated by a laser diode at a power of 2 W (Watt) and a wavelength of 808 nanometer (nm).

Figure 2:
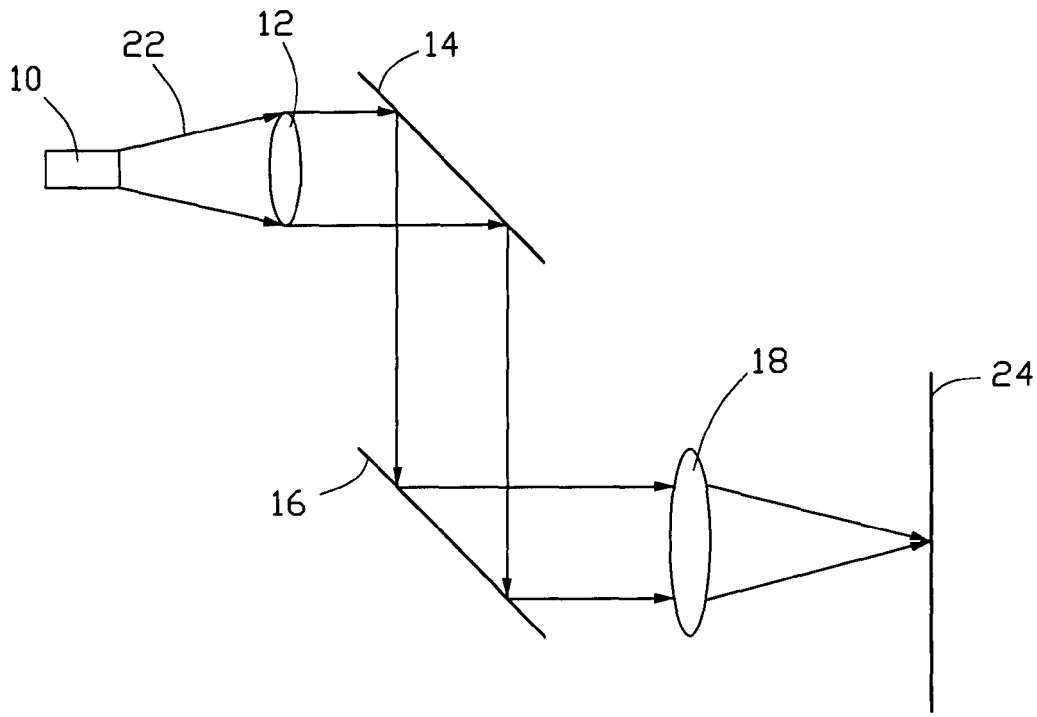
FIG. 2 shows a schematic view of the galvanometric scanning system used in the method of FIG. 1.

Referring to FIG. 2, the galvanometric scanning system 10 includes a collimating lens 12, a first vibration mirror 14, a second vibration mirror 16, and a focusing lens 18. A laser beam 22, generated by a laser beam generator 20, passes through the collimating lens 12 and forms a parallel laser beam. The parallel laser beam hits the first vibration mirror 14 and is deflected to the second vibration mirror 16, which is arranged in the opposite direction to the first vibration mirror 14. Then, the parallel laser beam, upon being deflected by the second vibration mirror 16, passes through the focusing lens 18 and focuses on the substrate 24 to locally heat the catalyst to a predetermined temperature. The area of the first vibration mirror 14 is larger than the area of the cross section of the parallel laser beam.

In one typical galvanometer scanning system 10, coils are wound on an armature. A magnetic or soft iron rotor suspends in the gap of the pole piece of said armature and is connected to the vibration mirror. When electrical energy is applied to the coil, it develops a magnetic field that will act against the field in the gap, causing the coil to move the shaft with the vibration mirror proportionally to the current applied.

In one useful embodiment, the first vibration mirror 14 and the second vibration mirror 16 are flat mirrors coated by reflective films. Due to the reflective films, the laser beam 22 can achieve a maximum reflectivity after it hits the vibration mirror. The galvanometric scanning system 10 and the position of the laser beam must be controlled, both horizontally (X-axis) and vertically (Y-axis), to create a pattern with two orthogonal axes. The first vibration mirror 14 and the second vibration mirror 16 deflect the parallel laser beam in an X and Y direction. Quite usefully, the first vibration mirror 14 and the second vibration mirror 16, which are controlled by a computer program, deflect in/at a high frequency. Because of that high frequency, the deflected laser beam can irradiate on the substrate 24 at a high scanning speed.

Quite suitably, the focusing lens 18 is a F-θ lens with a relative large diameter. As such, when substrate 24 is arranged within the focus of focusing lens 18, laser beam 22 can be irradiated on the substrate 24 in/over a large range.

It is to be understood that focused laser beam 22 can directly irradiate on the catalyst film on the first surface of the substrate or can be directed at/toward the second surface of the substrate 24, when the substrate 24 is made of a transparent material and/or has a small thickness (i.e., is thin (e.g., less than 100 microns)). When the laser beam 22 is irradiated upon the second surface of the substrate 24, the laser energy and/or the thermal energy generated thereby can pass/transfer through the substrate 24 and heat the catalyst film. If the substrate 24 is transparent, both thermal and laser energy can reach the catalyst film. However, if opaque, a reduced amount (if any) of laser (light) energy could be expected to reach the film, with thermal energy being more responsible for heating.

In step (e), due to catalyzing by the catalyst film, the carbon source gas supplied over the catalyst film is pyrolyzed in a gas phase into carbon units (C═C or C) and free hydrogen ($H_2$). The carbon units are absorbed on a free surface of catalyst film and diffused thereinto. When the catalyst film becomes supersaturated with the dissolved carbon units, carbon nanotube growth is initiated. As the intrusion of the carbon units into the catalyst film continues, an array of carbon nanotubes is formed. The additional hydrogen produced by the pyrolyzed reaction can help reduce the catalyst oxide and thus activate the catalyst. As such, the growth speed of the carbon nanotubes is increased, and the achievable height of the array of the carbon nanotubes is enhanced.

It is noted that the focused laser beam 22 is controlled by the galvanometric scanning system 10 to irradiate on the substrate 24. Due to the high scanning frequency, which is in the approximate range of 1000-100000 Hertz (Hz) of the first vibration mirror 14 and the second vibration mirror 16, laser scanning is performed at a high speed. Furthermore, the galvanometric scanning system 10 scans as a predetermined pattern controlled by a computer program and is thereby configured for promoting the formation of a carbon nanotube pattern.

The methods in the described present embodiments employ a first carbonaceous material in the catalyst film and/or a light absorption film, thereby providing the following virtues not found in conventional CVD growth methods. Firstly, the first carbonaceous material and/or the light absorption film will absorb laser light and thus facilitate heating of the catalyst to enable carbon nanotube growth. Secondly, the carbonaceous material will release carbon atoms to promote the nucleation of carbon nanotubes, when irradiated by laser beam. Thirdly, because of the initial presence of the carbon in the catalyst film, the supersaturation point for carbon therein will be reached sooner, permitting carbon nanotube growth to start earlier than might otherwise be possible. As such, the predetermined temperature for locally heating the catalyst film by laser beam can be less than ~600° C. Finally, a predetermined pattern of carbon nanotube array can be formed by the galvanometric scanning system. Moreover, the present method for growing arrays of carbon nanotubes can proceed in open air, without a closed reactor and/or vacuum conditions. Furthermore, the present method can synthesize large area arrays of carbon nanotubes by scanning the laser beam on the catalyst. For all of the various reasons provided, the operation of the present method is relatively simple, and the resultant cost thereof is reasonably low, compared to conventional methods.

Figure 3:
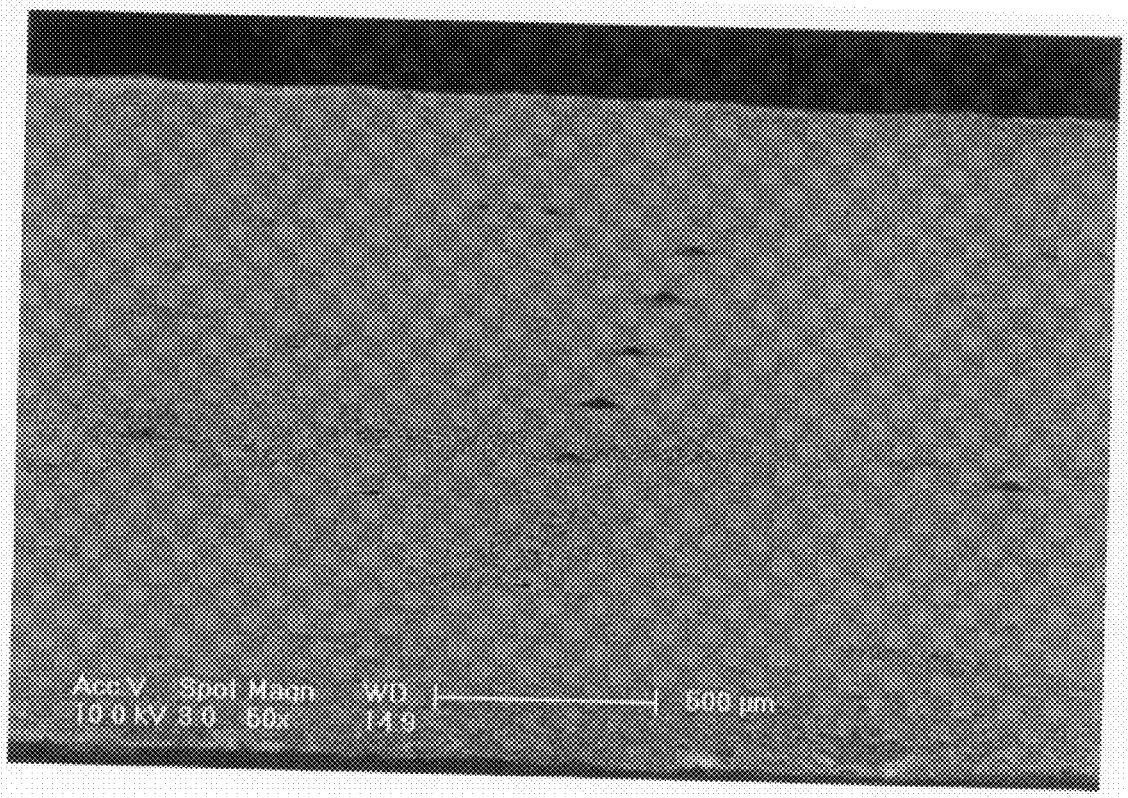
FIG. 3 shows a Scanning Electron Microscope (SEM) image of the array of carbon nanotubes formed/grown on a catalyst film by the method of FIG. 1.

Referring to FIG. 3, a pattern of carbon nanotubes array manufactured by the present method is shown. The catalyst film includes a carbonaceous material. The patterned carbon nanotube array is synthesized by irradiating the focused laser beam on the second surface of the substrate. The formed array, in this example, manifests a hill-shaped morphology. The diameter of the hill is in the approximate range from 50 to 80 micrometers. The maximum height of the hill is in the approximate range from 10 to 20 micrometers. The diameter of each carbon nanotube is in the approximate range from 40 to 80 nanometers.

Figure 4:
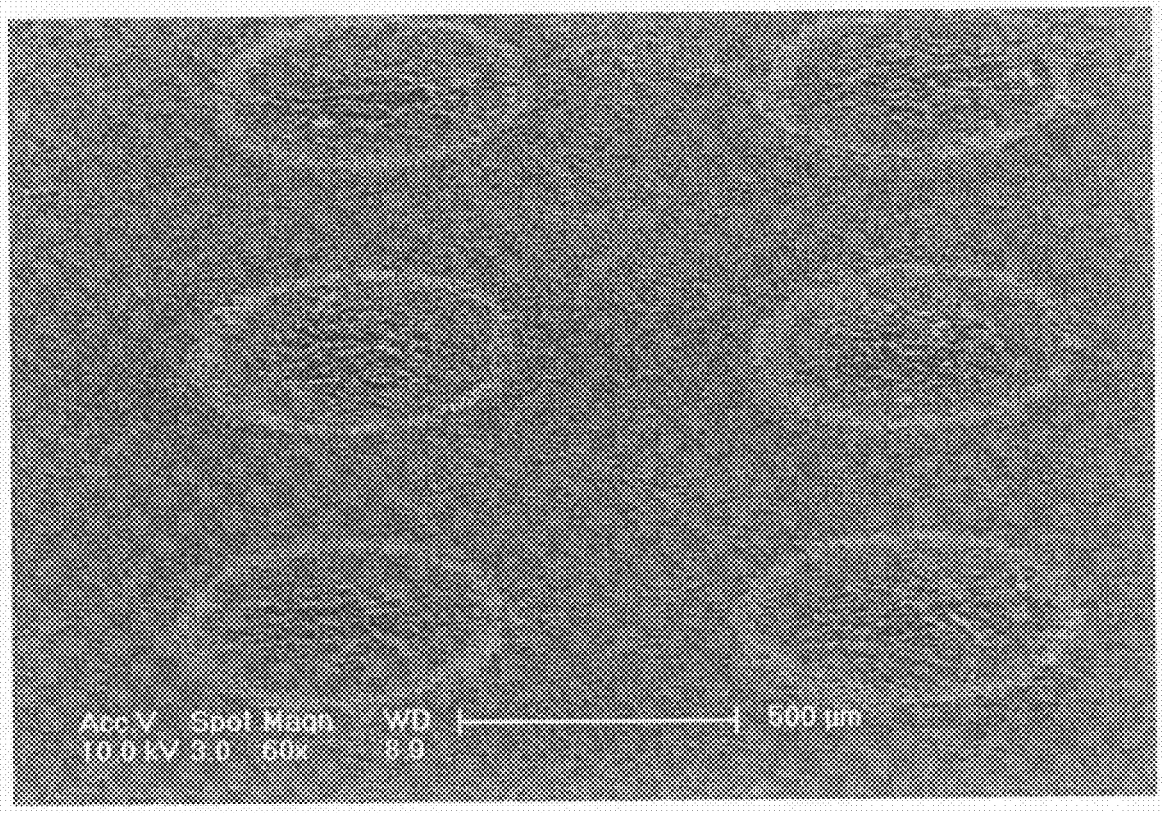
FIG. 4 shows a Scanning Electron Microscope (SEM) image of the array of carbon nanotubes formed/grown on a light absorption film by the method of FIG. 1.

Referring to FIG. 4, another carbon nanotube array pattern, as manufactured by the present method, is shown. A light absorption layer made of commercial colloidal graphite is formed between the catalyst film and substrate. The carbon nanotube array pattern is synthesized by irradiating the focused laser beam on the second surface of the substrate. The formed array of carbon nanotube, in this example, manifests a hill-shaped morphology. The diameter of the hill is in the approximate range from 100 to 200 micrometers. The maximum height of the hill is in the approximate range from 10 to 20 micrometers. The diameter of each of carbon nanotubes is in the approximate range from 10 to 30 nanometers.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for growing an array of carbon nanotubes, comprising the steps of:

(a) providing a substrate having a first surface and a second surface opposite to the first surface;

(b) forming a carbonaceous light adsorbing film a catalyst film on the first surface of the substrate;

(c) flowing a mixture of a carrier gas and a carbon source gas over the catalyst film;

(d) generating a laser beam using a galvanometric scanning system, directing the laser beam toward one of the first surface and the second surface to locally heat the catalyst film to a predetermined temperature; and (e) growing an array of the carbon nanotubes from the substrate.

2. The method as claimed in claim 1, wherein the galvanometric scanning system is comprised of a collimating lens, a first vibration mirror, a second vibration mirror, and a focusing lens.

3. The method as claimed in claim 2, wherein the first vibration mirror and the second vibration mirror are separately configured for deflecting the laser beam in X and Y directions.

4. The method as claimed in claim 2, wherein the focusing lens is a F-θ lens.

5. The method as claimed in claim 1, wherein the laser beam irradiates directly on the catalyst film on the first surface.

6. The method as claimed in claim 5, wherein the substrate is comprised of at least one material selected from a group consisting of silicon, silicon dioxide, and a metal.

7. The method as claimed in claim 1, wherein the laser beam irradiates on the second surface of the substrate.

8. The method as claimed in claim 7, wherein the substrate is comprised of a material selected from a group consisting of a glass and a plastic material.

9. The method as claimed in claim 1, wherein step (b) further comprises the substeps of:

(b1) providing a mixture of a dispersant and a first carbonaceous material;

(b2) combining the mixture with a solvent to form a solution;

(b3) ultrasonically agitating the solution to promote dispersing of the first carbonaceous material therein;

(b4) adding a catalyst soluble material into the dispersed solution to form a catalyst solution;

(b5) coating the catalyst solution on the first surface of the substrate; and (b6) baking the substrate to form a catalyst film on the first surface of the substrate, the catalyst film including the first carbonaceous material therein.

10. The method as claimed in claim 9, wherein the first carbonaceous material comprises at least one of carbon black and graphite.

11. The method as claimed in claim 9, wherein in step (b4), the soluble catalyst material comprises at least one material selected from the group consisting of magnesium nitrate, iron nitrate, cobalt nitrate, and nickel nitrate.

12. The method as claimed in claim 1, wherein a thickness of the catalyst film is in the approximate range from 10 to 100 micrometers.

13. The method as claimed in claim 1, wherein the step of forming the light absorption film further comprises the substeps of:

(f1) applying a second carbonaceous material onto the substrate;

(f2) gradually heating the second carbonaceous material to 300° C.~450° C. in a gas atmosphere of at least one of nitrogen and a noble gas;

(f3) baking the second carbonaceous material; and (f4) cooling down the second carbonaceous material to room temperature and then forming the light absorption film on the substrate.

14. The method as claimed in claim 13, wherein the second carbonaceous material comprises colloidal graphite.

15. The method as claimed in claim 13, wherein a thickness of the light absorption film is in the approximate range from 1 to 20 micrometers.

16. The method as claimed in claim 1, wherein step (b) further comprises the substeps of:

(b7) providing a catalyst solution;

(b8) coating the catalyst solution on the light absorption film; and (b9) baking the catalyst solution to form a catalyst film.

17. A method for growing an array of carbon nanotubes comprising the steps of:

(a) providing a substrate having a first surface and a second surface opposite to the first surface;

(b) forming a catalyst film which is comprised of a carbonaceous light adsorbing film on the first surface of the substrate;

(c) flowing a mixture of a carrier gas and a carbon source gas over the catalyst film;

(d) generating a laser beam using a galvanometric scanning system, directing the laser beam toward one of the first surface and the second surface to locally heat hte catalyst film to a predetermined temperature; and (e) growing an array of carbon nanotubes from the substrate.

* * * * *